US006726201B2

(12) United States Patent
Studer

(10) Patent No.: US 6,726,201 B2
(45) Date of Patent: Apr. 27, 2004

(54) METHOD AND DEVICE FOR THE HORIZONTAL POSITIONING OF SERIALLY CONVEYED, FLAT OBJECTS

(75) Inventor: Beat Studer, Durnten (CH)

(73) Assignee: Ferag AG, Hinwil (CH)

( * ) Notice: Subject to any disclaimer, the term of this patent is extended or adjusted under 35 U.S.C. 154(b) by 128 days.

(21) Appl. No.: 09/859,184

(22) Filed: May 16, 2001

(65) Prior Publication Data

US 2001/0048190 A1 Dec. 6, 2001

(30) Foreign Application Priority Data

May 17, 2000 (CH) ..... 0987/00

(51) Int. Cl.[7] ..... B65H 29/04

(52) U.S. Cl. ..... 271/204; 271/69; 271/182; 271/198; 271/202; 271/205; 271/270; 198/374; 198/680

(58) Field of Search ..... 271/69, 182, 198, 271/202, 204, 205, 270; 198/374, 411, 415, 680

(56) References Cited

U.S. PATENT DOCUMENTS

| | | | | |
|---|---|---|---|---|
| 4,007,824 A | | 2/1977 | Reist | |
| 4,289,052 A | * | 9/1981 | Woolston et al. | 271/202 |
| 4,604,851 A | | 8/1986 | Reist | |
| 4,606,173 A | * | 8/1986 | Meier | 271/204 |
| 5,301,937 A | * | 4/1994 | Hansch | 271/204 |
| 5,957,449 A | | 9/1999 | Luthi | |
| 6,193,229 B1 | * | 2/2001 | Hall et al. | 271/109 |

FOREIGN PATENT DOCUMENTS

GB 2 044 228 A 10/1980

OTHER PUBLICATIONS

WO 99/33731, Publication Date: Jul. 8, 1999, Conveyor System.

* cited by examiner

*Primary Examiner*—Eileen Lillis
*Assistant Examiner*—Michael Lowe
(74) *Attorney, Agent, or Firm*—Rankin, Hill, Porter & Clark LLP

(57) ABSTRACT

For the horizontal positioning of serially supplied, flat objects (1) to be conveyed onward, the objects (1) are supplied suspended, one of their main surfaces (10) facing downstream and the other main surface (11) facing upstream. Prior to positioning, lower edge zones (13) of the objects (1) are selectively accelerated or retarded relative to the upper edge zones (12), so that the objects (1) are brought into a position inclined relative to the vertical. Thereafter, the upper edge zones (12) are released and the objects (1), under the influence of gravity, are positioned on an onward conveying device, selectively either the downstream or the upstream main surface (10 or 11) facing upwards. For retarding or accelerating the lower edge zones (13), for example, a conveyor belt or two conveyor belts adjoining one another are utilized. The speed (v.3) of the conveyor belts is adjustable to convert from accelerating operation to retarding operation. The method and device permits easy conversion between modes of operation, and may be utilized for collating printed products or printed part products.

15 Claims, 5 Drawing Sheets

METHOD AND DEVICE FOR THE HORIZONTAL POSITIONING OF SERIALLY CONVEYED, FLAT OBJECTS

BACKGROUND OF THE INVENTION

The present invention is generally related to piece good conveyance and, more particularly, a method and device for horizontally positioning for onward conveyance a large number of identical or similar flat objects that are supplied in a serial stream.

One example of an application, in which serially supplied, flat objects are positioned horizontally on a conveying device, is the collating of parts of printed products to form stacks of part products. The collated stacks are then each processed into a finished printed product (e.g., a book or a brochure), usually by binding or stapling. For such a collating operation, for example, a conveyor belt is utilized as a conveying device, with either transverse walls or toes (catches) at a distance to one another in the conveying direction and dividing the conveying track into conveying compartments of equal size. These conveying compartments are transported either continuously or in a clocked cycle past a row of feed points arranged one behind the other. At each of the feed points a part product is deposited in every passing conveying compartment, so that during transportation along the conveying track a stack of part products is produced in every conveying compartment. At the end of the stack conveying track, each of the stacks has a number of part products equivalent to the number of the active feed points it has passed.

Instead of using the named conveyor belt with conveying toes (catches) or transverse walls, the stacks in production can also be pushed along a suitable base by transport cams (catches). Such pushed conveying can be carried out continuously or in a clocked cycle alternating with standstills.

For the supply and horizontal positioning necessary in the mentioned application example, the flat objects are usually conveyed toward a feed point parallel to their main surfaces and one after the other or overlapping one another and they are pushed onto the onward conveying device, resp., onto a stack of other flat objects being transported past the feed point with the help of the onward conveying device. The feeding direction for this purpose is directed toward the onward conveying direction from above and advantageously intersects the plane (conveying plane), on which the conveyed objects are lying, at an acute angle.

In the case of clocked onward conveyance, for which, for example, conveying compartments are stopped for feeding steps and are transported on between feeding steps, the supply direction can be relatively freely selected relative to the onward conveying direction (projection of the supply direction into the onward conveying plane). This means that the supply direction, for example, can be transverse to the onward conveying direction (transverse supply) or it can be the same as the onward conveying direction (parallel supply). In the case of continuous onward conveying, supply of the latter type is particularly suitable, i.e. supply with a feed direction lying in the same plane perpendicular to the onward conveying plane as the onward conveying direction and approaching the onward conveying line from above and at an acute angle.

In the case of square or rectangular, flat objects being supplied by transverse supply, the edges being directed downstream in the supply stream are positioned on the one side of the onward conveying means opposite the feed and they are oriented parallel to the onward conveying direction. In the case of a parallel supply, the edges being oriented downstream in the supply stream remain the leading edges on onwards conveyance being aligned perpendicular to the conveying direction. For flat objects with other shapes, the same applies in analogy for corresponding edge zones.

Known devices for collating printed products, for example, comprise sheet feeders for supplying the part products. Usually these sheet feeders are supplied with part products by hand, the part products being deposited in a stacking shaft. From the stacking shaft the part products are decollated to form a conveying stream. In this stream, they are conveyed toward the feed point essentially parallel to their main surfaces one after the other or overlapping one another and they are pushed onto the stacks under production. This means that the position of the products on the stacks under production is correlated in a fixed manner with the position of the products in the stacking shaft. Therefore, for a predefined product position on the stacks being produced, the products have to be filled into the stacking shaft in a corresponding manner.

It is also known to supply feed points by uncoiling stations, in which stations a stream of imbricated printed products is uncoiled from a corresponding coil and is supplied to the feed point. Feeding by means of a continuously supplied product stream is also known. In both cases it is advantageous to interpose a buffer between the feed point and the supply device. For such equipped feed points also, there is a fixed relationship between the product orientation in the supply stream and the product orientation on the stacks being produced by collating. If this correlation is to be changeable, then devices have to be provided, with which the supply stream of imbricated products can be reorganized, i.e., re-scaling devices, e.g. for reversing the stream or for recoiling a product coil. Devices of this kind are expensive and take up a lot of space.

It is also known to produce stacks from a plurality of different printed products, such as newspapers, magazines, advertising brochures and other advertising material using a collating device and then package the stacks to form complete shipping units e.g. using a folio assembler. In shipping units of this kind the orientation of the individual products is not predefined, as is the case for a stack of part products to be assembled to form one product. On the contrary, there is the desire to arrange the two outermost products of the stack such that the front side of both is visible through the folio, and to arrange the products inside the stack such that thicker folded edges are distributed as uniformly as possible over two opposite sides of the stack to stabilize the stack. Because usually only relatively small numbers of the mentioned shipping units with the same composition have to be made up, this signifies that the supply orientation of the products has to be changed time and again.

With the known supply systems, such changes have to be carried out by persons operating the sheet feeders by filling the products into the stacking shaft with varying orientations depending on the shipping units to be produced. This quite invariably leads to mistakes. Other supply systems have to be correspondingly retooled for such changes and then set up or adjusted for the change. As already mentioned above, this is expensive.

SUMMARY OF THE INVENTION

An object of the present invention is a method and a device by means of which flat objects, which are supplied in a serial conveying stream, can be horizontally positioned for an onward conveyance, wherein with the same orientation of all objects in the supply stream it shall be possible, with the simplest of measures, to set two different orientations for the objects onward conveyance. In achieving the objective, the method is designed such that it can be carried out with a simple device, which can easily be adjusted for two positioning orientations.

In accordance with the present invention, flat objects are supplied in suspended manner and with their main surfaces vertical or inclined (not parallel) to the feeding direction such that one of their main surfaces is facing downstream and the other one is facing upstream. This means that the flat objects in the supply stream are held individually or, if required, in small groups by grippers by an upper edge zone. Lower edge zones are movable in the feeding direction relative to the upper edge zones as a result of a corresponding flexibility of the objects and/or of a corresponding ability of the grippers to swivel. This means that, by using appropriate means, the objects can be brought into positions in which the lower edge zone of each object is not situated vertically below the upper edge zone held by a gripper, but rather is either ahead of or trails behind the upper edge zone.

Immediately before the horizontal positioning of an object, a positioning device engages the lower edge zone of the objects and accelerates or retards this lower edge zone versus the upper edge zone in dependence of the desired positioning orientation. As a result of this, the object is brought into an inclined position relative to its vertical position, which it assumes in freely suspended conveyance. When the object is sufficiently inclined, it is released by the gripper and is finally positioned by the force of gravity and, if required, guided by the positioning means.

If, before positioning, the lower edge zone is accelerated versus the upper edge zone, the one main surface of the flat object that was facing downstream in the supply stream is facing upwards after positioning. On the other hand if, before positioning, the lower edge zone, however, is retarded, then the one main surface that was facing upstream in the supply stream is facing upwards.

Onward conveyance, as in the case of the known methods briefly described above, can be clocked or continuous. In the case of clocked onward conveyance, in which the objects are essentially positioned on a conveying surface that is stationary at this point in time, the feeding, for example, can be transverse to the direction of onward conveyance or parallel to it. In the case of continuous onward conveyance, feeding has advantageously substantially the same direction as onward conveyance. For parallel feeding, a lower edge zone accelerated prior to positioning becomes the leading edge zone for onward conveyance; a correspondingly retarded edge zone becomes the trailing edge zone.

The device of the present invention includes a supply means and a positioning means, both being matched to an onward conveying means.

The supply means supplies the flat objects in a suspended position in a controlled manner. For this purpose, it has a multitude of grippers displaceable under control in the feeding direction. Advantageously, these grippers are relatively freely swivellable in the feeding direction. The grippers, for example, are attached to a circulating conveying organ at a regular distance from one another. The grippers, however, can also be displaceable more or less independent of one another and, for example, can be buffered ahead of the feeding point and called up from the buffer specifically for the feeding operation.

The supply means furthermore comprises deactivation means, through which the grippers are deactivated at a predefined release point for releasing the objects. The deactivation means can be controlled such that only a predetermined part of the grippers is deactivated, while not deactivated grippers pass the release point without releasing the object they are gripping.

The positioning means serves to retard or accelerate lower edge zones of objects conveyed by the supply means prior to positioning. The positioning means, for example, is designed as a conveyor belt, which extends underneath the grippers and which forms an acute angle with the feeding direction, the apex of which is in the area of the release point. The speed with which the positioning means moves the lower edge zones bward the release point is adjustable to a minimum of two values. In this respect, one of these speeds for accomplishing an acceleration of the lower edge zones is greater than the conveying speed of the feeding means and the other one for a corresponding retardation is smaller than the conveying speed or else can be zero. If so required, the position of the positioning means is adjustable relative to the supply means.

The supply means and the positioning means are matched to one another and to the onward conveying means such that an object, when it is released by the gripper, has an inclined position. This inclination has such an extent, that the object can be positioned at the predetermined point of the onward conveying means (e.g., in a conveying compartment) having the predetermined orientation (leading or trailing main surface on top) by the effect of the force of gravity and if necessary with controlled assistance by parts of the positioning means.

BRIEF DESCRIPTION OF THE DRAWINGS

The method according to the invention and an exemplary embodiment of the corresponding device are described in more detail in association with the following drawings, wherein.

DETAILED DESCRIPTION OF THE PREFERRED EMBODIMENTS

Figure 1:
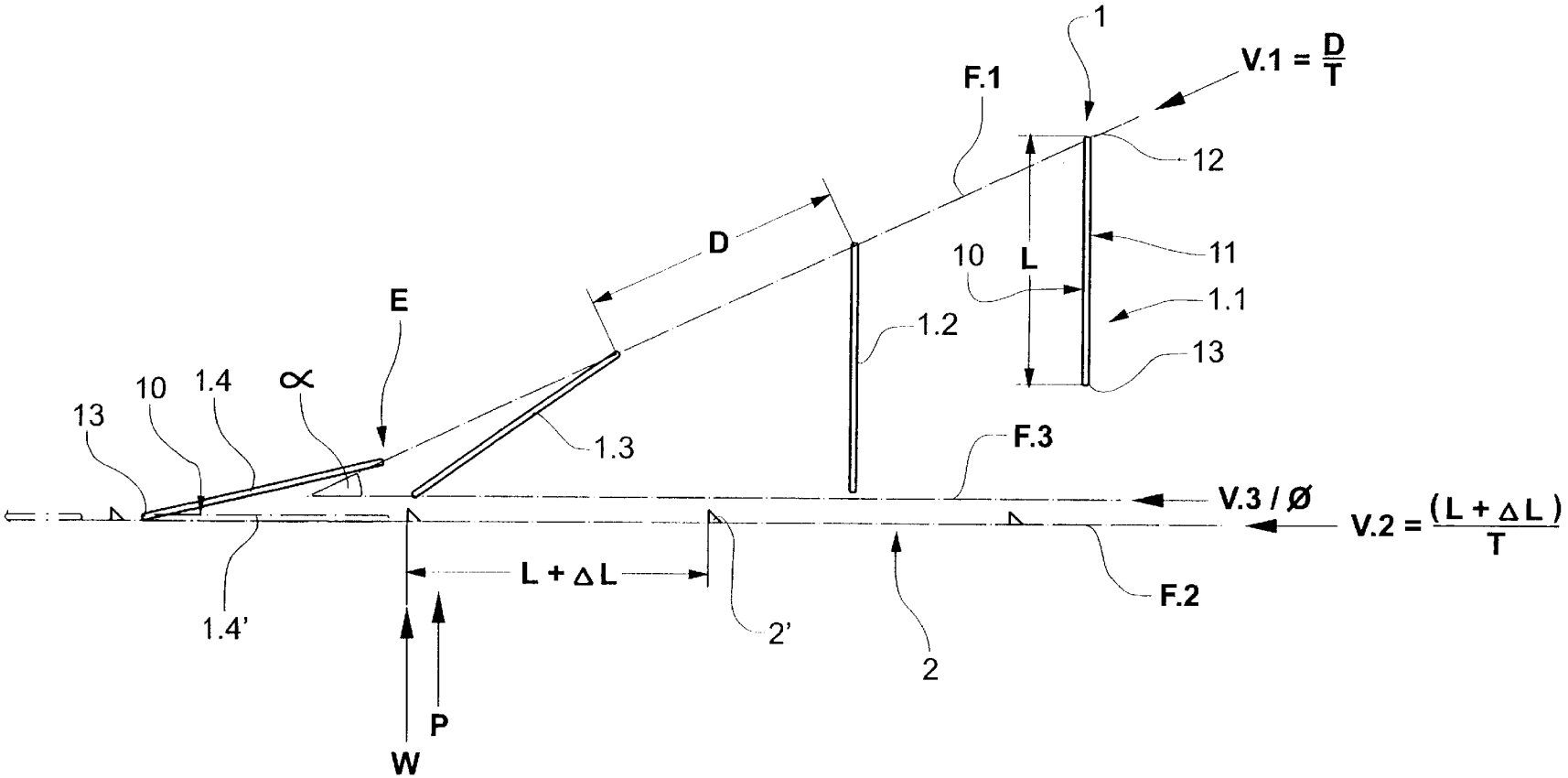
FIGS. 1 and 2 show the operating principle of the method and of the device in accordance with the present invention, with FIG. 1 showing acceleration of the lower edge zones and FIG. 2 showing retardation of the lower edge zones)
Figure 2:
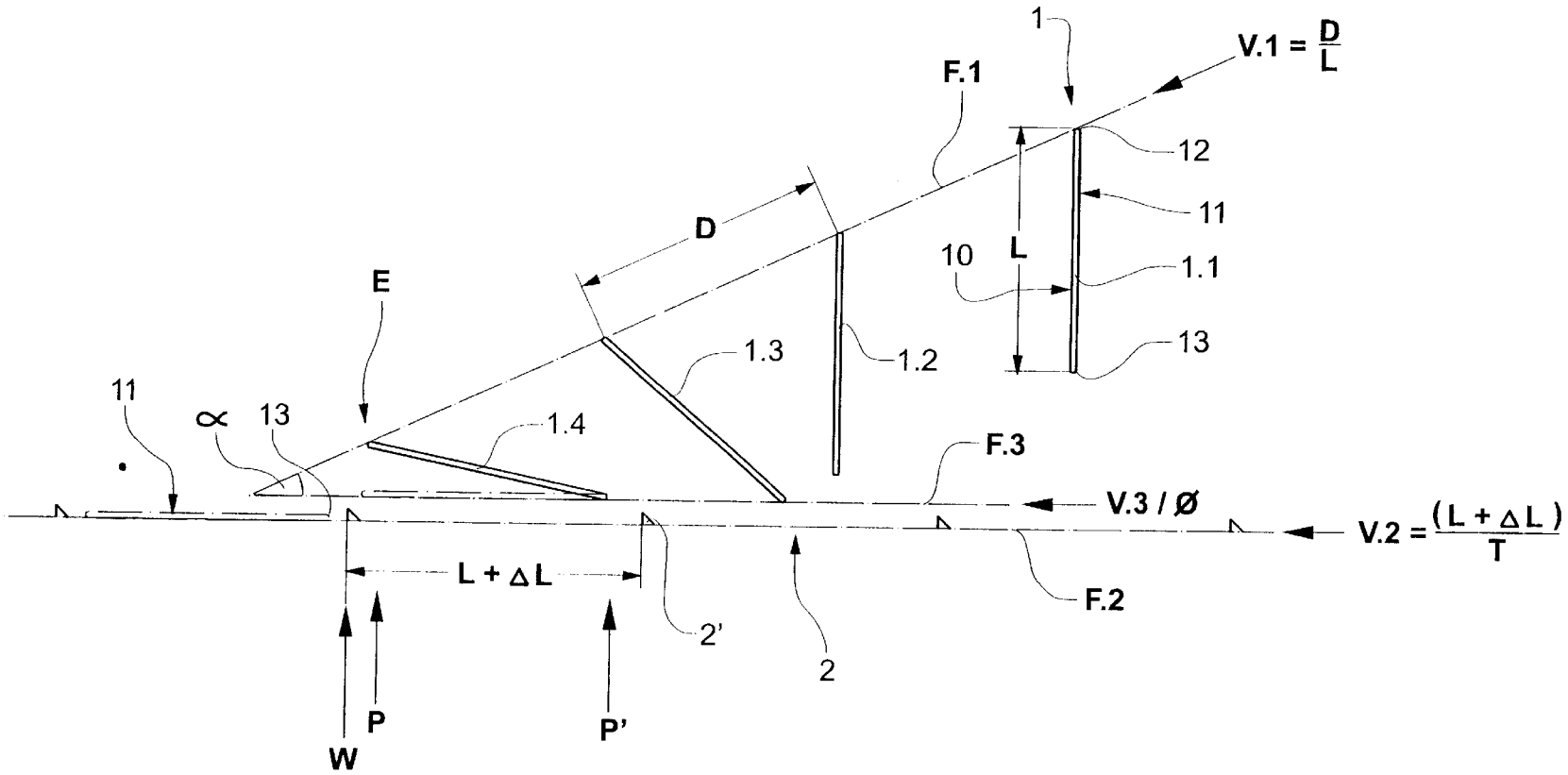

FIGS. 1 and 2 schematically illustrate the operating principle of the method and device according to the invention on an exemplary embodiment. In FIG. 1, operation with acceleration of the lower edge zones, i.e. for horizontal positioning with the leading main surface on top, is illustrated. In FIG. 2, operation with retardation of the lower edge zones, i.e. for horizontal positioning with the trailing main surface on top, is illustrated. These drawings illustrate a continuous onward conveyance in conveying compartments with parallel feeding. For a clocked onward conveyance, the Figures and the explanations of the following paragraphs will need to be adapted correspondingly.

FIGS. 1 and 2 depict as dot-and-dash lines the feeding direction F.1, which in essence designates the conveying path of the upper edge zones of the objects being supplied, the direction of onward conveyance F.2 and the positioning means conveying direction F.3, which essentially designates the conveying path of the lower edge zones of the objects being supplied. All three conveying directions are situated one beneath the other in one plane (paper plane of the drawing Figures), which is at right angles to the onward conveying plane (perpendicular to the paper plane of the Figures). In this, F.2 and F.3 run essentially parallel to one another or slightly toward one another and F.1 forms an acute angle $\alpha$ with F.3, resp., F.2. A release point E is situated in an area of the intersection point of F.1 and F.3, as illustrated.

FIGS. 1 and 2 also illustrate a plurality of flat objects 1 being supplied and positioned. These drawings can also be understood as depicting only one object in phases (1.1 to 1.4) of the supplying and positioning process, the point in time of successive phases differing by one conveying clock cycle T. The objects 1 have two essentially parallel main surfaces 10 and 11, the surfaces being aligned transverse to the paper plane, and they have upper edge zones 12 and lower edge zones 13. During supply, one of the main surfaces (10) is facing downstream, the other one (11) is facing upstream. The depicted objects 1 are not significantly bendable, so that the grippers (not shown) of the supply means, which grippers hold the objects, have to be designed as freely swivelling in the feeding direction. The objects 1 have a suspended length L and are conveyed, for example, with unchanging distances D from one another, wherein D advantageously is as small as possible.

Furthermore, the FIGS. 1 and 2 show an onward conveying means being partitioned into conveying compartments 2 of the same size by conveying toes 2'. The conveying compartments 2 have a length $L+\Delta L$ in the direction of onward conveyance F.2, which is greater than the suspended length L of the objects.

The feeding speed v.1 is DT, the onward conveying speed v.2 is $(L+\Delta L)/T$, wherein T is the length of a conveying cycle, i.e., the length of the time period between two equivalent conveying situations at any point of the conveying system.

According to FIG. 1, the object 1.4 is just being released, the object 1.3 is one conveying clock cycle before it's release, the object 1.2 two conveying clock cycles and the object 1.1 three conveying cycles before it's release. The object 1.1 is still within the zone of freely suspended conveyance, in which zone no accelerating force is exerted on the lower edge zones 13, so that the lower edge zone 13 of the object 1.1 is positioned essentially vertically underneath the upper edge zone 12. The lower edge zone 13 of the object 1.2 has just reached the action area of the positioning means, i.e., object 1.2 is in a position in which acceleration of the lower edge zone 13 versus the upper edge zone 12 is starting. The lower edge zone 13 of the object 1.3 is ready running ahead of the upper edge zone 12. The object 1.4 has reached the release point E and is released from the gripper, in order to fall onto the onward conveying means (object 1.4', dot-and-dash line), where it is conveyed onwards with the main surface 10, which was facing downstream on being supplied, now directed upwards and with the lower edge zone 13 leading.

From FIG. 1 it is apparent that, at least in the case of a constant feeding speed, the speed of the lower edge zones is not a constant speed. In order for the positioning means to be able to accelerate these lower edge zones, its speed has to be greater than the initial and greatest speed of the lower edge zones. This speed is essentially dependent on the angle $\alpha$ and the length L. As will still have to be demonstrated, these parameters are advantageously arranged such that the speed v.3 of the positioning means is approximately the same as the speed v.2 of the onward conveying means.

From FIG. 1 it is apparent that, for an operation with acceleration of the lower edge zones 13, i.e. for horizontal positioning with leading main surfaces 10 directed upwards, the following necessary and desirable conditions apply:

- The speed v.3 of the positioning means has to be greater than the speed v.1 of the supply means.
- The conveying compartment, in which an object (1.4) is to be positioned, has to extend by at least the length L downstream from the release point E at the time of the release of the object.
- In order to avoid interactions between a just-released object (1.4) and a following object (1.3), the parameter D is advantageously matched to the length L such that the lower edge zone of an object (1.3) has not yet reached the level of the release point E, when the preceding object (1.4) is released (for rigid objects and for a small distance between F.2 and F.3: $D \cong L$, for bendable objects smaller).
- The action of the positioning means has to end in a position P upstream of the release point E, advantageously in a manner such that the end of the positioning means guides a lower edge zone into the one conveying compartment, in which the corresponding object is to be deposited. (P is approximately at position W of the end of the onward conveying compartment, into which an object is just being deposited).
- For a problem-free transfer of the lower edge zone from the positioning means to the onward conveying means, the speed v.3 of the positioning means is advantageously approximately the same as the speed v.2 of the onward conveying means.

FIG. 2 illustrates the same arrangement as FIG. 1, which, however, is operated with a retardation of the lower edge zones, i.e. for horizontal positioning with the trailing main surface 11 directed upwards. The reference signs are the same and the description is to be adapted correspondingly.

From FIG. 2 it is apparent that the speed of the lower edge zones 13 is not a constant speed; with the first contact with the positioning means it is so to say zero and then increases. In order for the positioning means to be able to retard the lower edge zones, the speed v.3 of the positioning means therefore has to be very low or the positioning means has to be at a standstill. As soon as the upper edge zone has reached the release point E, the retarding effect of the positioning means on the lower edge zone has to cease (position P', upstream of E by around L). If the positioning means reaches further toward the release point E than up to the position P', it must serve as a guide for the released objects onto the onward conveying means in this forward region and, therefore, should advantageously have a speed, that is approximately the same as the speed v.2 of the onward conveying means.

From FIG. 2 it is apparent that, for operation with retardation of the lower edge zones 13, i.e. for horizontal positioning with trailing main surfaces 11 directed upwards, the following necessary and desirable conditions apply:

- The speed v.3 of the positioning means has to be smaller than the speed v.1 of the supply means. Advantageously, it is equal to zero.
- The conveying compartment, in which an object is to be positioned, has to extend upstream from the release point E by at least the length L at the time of the release of the object.

The retarding effect of the positioning means must cease for every object at the time it is released, i.e. upstream of the release point E by approximately L (position P').

If the positioning means extends further toward the release point E, then this exit region of the positioning means advantageously has a speed v.3, which approximately corresponds to the onward conveying speed v.2.

From a comparison of FIGS. 1 and 2 it is apparent that, for conversion from an operation accelerating the lower edge zones 13 to one retarding the lower edge zones 13, in essence only the speed v.3 of the positioning means and the synchronization between the supply means and the onward conveyance (synchronization between feeding grippers and onward conveying compartments 2) have to be adapted. In addition, the positioning means can be displaced upstream (end of P into position P'). The last mentioned adjustment can be avoided if the positioning means consists of two parts: an entry zone, in which it can be switched on or off and that extends downstream up to the position P', and an exit zone, the speed of which is independent of the mode of operation and which extends between the positions P' and P. All other parameters, in particular the position of the release point and the distance D of the supplied objects, do not have to be adjusted.

For handling objects with shorter suspended lengths than a length being adapted to the length of the conveying compartments, the height of the positioning means and/or of the supply means above the onward conveying means may be adjustable.

Figure 3:
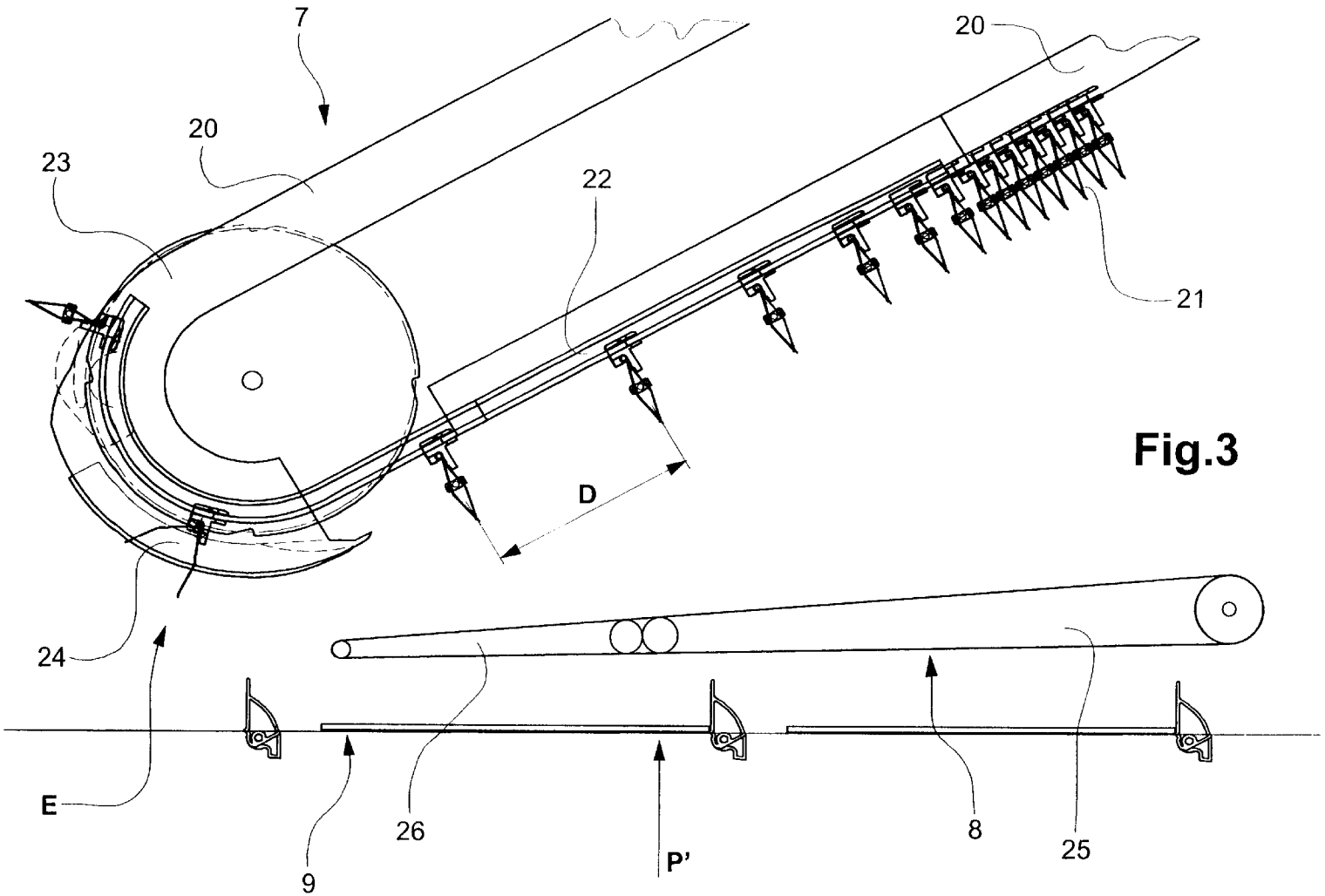
FIG. 3 shows an exemplary embodiment of the device according to the invention.
Figure 4:
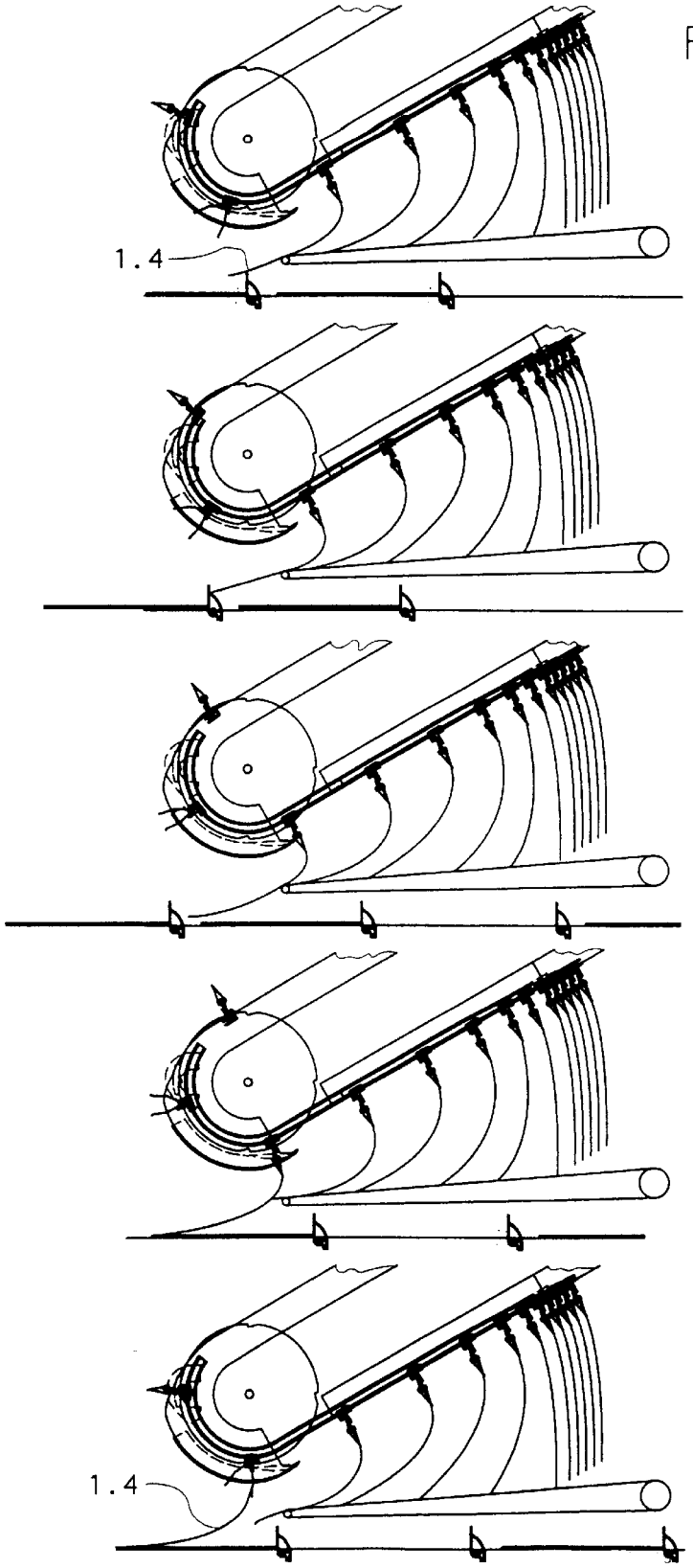
FIGS. 4A–4E show successive feeding and positioning phases of the device according to FIG. 3 operating with accelerated, lower edge zones; and, FIGS. 5A–5E show successive feeding and positioning phases of the device according to FIG. 3 operating with retarded, lower edge zones.

FIG. 3 in more detail depicts an exemplary embodiment of the device according to the invention. The supply means 7 of this device comprises rails 20, along which grippers 21 are moveable essentially independently of one another toward the release point E and away from the release point E. Upstream of the release point E and as close as possible to it, the grippers 21 are buffered, released from the buffer as required and then, for example, by means of a screw conveyor 22 with a pitch, which increases toward the release point E, are transported toward the release point. The grippers are clocked to have a distance D from one another, which is suitable for the positioning. In the region of the release point E, the grippers are taken over by a clutch drive wheel 23 and are transported onwards. At the release point E, they are opened by means of a suitable cam 24.

The use of grippers that are movable independently of one another has the advantage that the objects can be buffered only a little distance upstream of the release point and can be individually released from the buffering. This also has the benefit that the given condition for the distance D between the objects (see above) can be satisfied at the same time as the desire for small spacings between the objects.

A device suitable as a supply means 7 of the device in accordance with the invention, is described, for example, in the publication WO-99/33731.

The positioning means 8 comprises an entry conveyor belt 25 and an exit conveyor belt 26, which two conveyor belts meet in the position P'. For operation with edge acceleration, the entry conveyor belt 25 has a speed, which is approximately the same as the speed of the onward conveying device 9 and the same as the speed of the exit conveyor belt 26. For operation with edge retardation, the entry conveyor belt 25 is stationary. Instead of the two conveyor belts 25 and 26, it is also possible to use a single conveyor belt, with a speed, which is approximately the same as the speed of the onward conveying means 9. For operation with edge retardation, the entry region of this conveyor belt is covered with suitable means.

Figure 5:
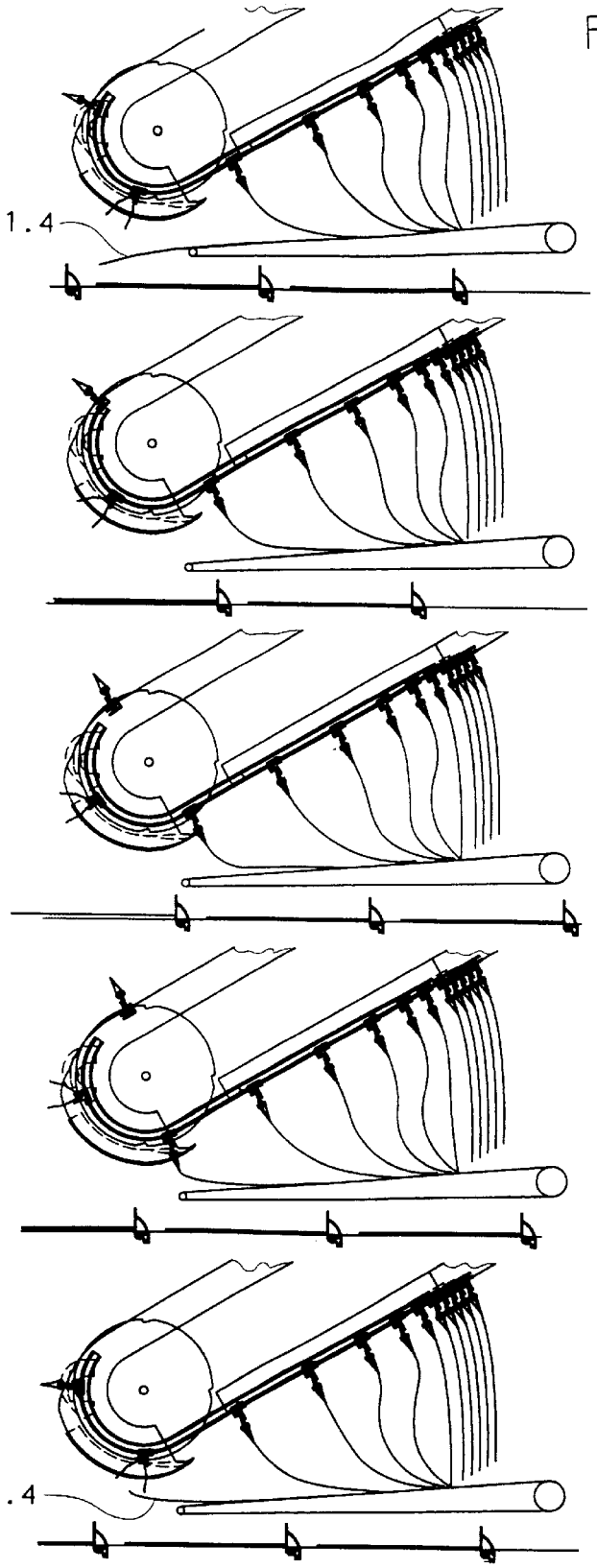

FIGS. 4A–4E illustrate five phases of a conveying clock cycle of the device of FIG. 3 operated with edge acceleration. FIGS. 5A–5E illustrate five phases of a conveying clock cycle of the device of FIG. 3 operated with edge retardation. In each case, the first phase (FIG. 4A; FIG. 5A) depicts an object 1.4 one conveying clock cycle before it's release and the last phase (FIG. 4E; FIG. 5E) depicts the release of this object. As the device is the same as the one illustrated in FIG. 3, reference numbers are omitted from FIGS. 4A–4E and FIGS. 5A–5E for purpose of clarity.

FIGS. 4A–5E also further clarify the difference in the handling of essentially bendable flat objects, as newspapers and magazines usually are, compared to the handling of the essentially rigid objects depicted in FIGS. 1 and 2.

The method and device according to the invention are suitable for collating printed products or printed part products and, in particular, for collating different printed products to form stacks that are then assembled into folios for shipping.

What is claimed is:

1. A method for horizontal positioning of flat objects (1), each flat object having two essentially parallel main surfaces (10, 11), the method comprising the steps of:

supplying the flat objects serially in a feeding direction (F.1), each object being held by an upper edge zone (12) and having a lower edge zone (13) freely suspended, one main surface (10) of each object facing downstream and the other main surface (11) facing upstream, the feeding direction being directed toward an onward conveying direction (F.2) at an acute angle from above;

during said supplying step, bringing the objects (1) into a position inclined to the vertical by selectively accelerating or retarding the lower edge zones (13) relative to the upper edge zones (12);

releasing the upper edge zone (12) of each object (1) when the object is at a release point (E) in their inclined position and, under the influence of gravity, positioning the released objects with selectively either said one main surface or said other main surface facing upwards; and conveying the positioned objects onward in the onward conveying direction (F.2);

wherein the objects are horizontally positioned in conveying compartments (2), which conveying compartments (2) are continuously conveyed in the onward conveying direction (F.2); and wherein, for converting from accelerating operation to retarding operation, the synchronization between the supply of the objects (1) and the conveyance of the conveying compartments (2) is modified.

2. The method in accordance with claim 1, wherein, following release of the upper edge zone (12), the objects (1) are guided into position.

3. The method in accordance with claim 1, wherein a projection of the feeding direction (F.1) onto a horizontal plane is generally parallel to the onward conveying direction (F.2).

4. The method in accordance with claim 1, wherein, for acceleration, the lower edge zones (13) are brought into contact with a positioning means (8), which positioning means (8) has a speed (v.3) in the same direction as the onward conveyance and in the same range as the onward conveying speed (v.2).

5. The method in accordance with claim 1, wherein, for retardation, the lower edge zones (13) are brought into contact with a stationary positioning means (8).

6. The method in accordance with claim 5, wherein the positioning means (8) comprises an exit region directed toward the release point (E), said exit region having a speed (v.3) in the same direction as the onward conveying direction (F.2), said exit region speed (v.3) being approximately the same as the onward conveying speed (v.2).

7. A device for the horizontal positioning of serially supplied, flat objects (1) to be conveyed onward, the device comprising:

supply means (7) defining a feeding direction (F.1), onward conveying means (9) defining an onward conveying direction (F.2) and positioning means (8), wherein the feeding direction (F.1) is directed toward the onward conveying direction (F.2) from above at an acute angle, wherein the supply means (7) comprises rails (20) and a plurality of grippers (21) movable independently of one another along the rails, said grippers (21) being movable one after the other in the feeding direction (F.1) and being designed each for holding one object (1) at an upper edge zone (12) of said object, lower edge zones (13) of each of said objects being freely movable in the feeding direction (F.1) relative to the upper edge zones (12), wherein the supply means further comprises a deactivation means for deactivating the grippers (21) and releasing the held object (1) at a release point (E), wherein the positioning means (8) defines a conveying direction (F.3) of the lower edge zones of the objects (1) upstream of the release point (E) and is arranged between the supply means (7) and the onward conveying means (9) in such a manner that said conveying direction (F.3) forms an acute angle ($\alpha$) with the feeding direction (F.1), and wherein the positioning means is operated in one of two selectable modes including two different speeds toward the release point (E), and wherein means for buffering the grippers (21), means for taking the grippers (21) from the buffering means, and means for accelerating and clock cycling the grippers (21) are provided upstream of the release point (E), and wherein means for onward conveyance of the grippers (21) is provided in a region of the release point (E).

8. The device in accordance with claim 7, wherein the grippers (21) are adapted to swivel in the feeding direction (F.1).

9. The device according to claim 7, wherein the positioning means (8) is displaceable in the direction of the conveying direction (F.3).

10. The device in accordance with claim 7, wherein the positioning means (8) comprises an entry region and an exit region, the entry region being driven at a first speed (v.3) and the exit region being driven with at second speed (v.3) equal to the first speed.

11. The device in accordance with claim 10, wherein the positioning means (8) comprises a conveyor belt and the entry region is covered by a stationary cover that serves to retard movement of the lower edges zones of the objects relative to the upper edge zones of the objects.

12. The device in accordance with claim 7, wherein the positioning means (8) comprises two conveyor belts (25, 26) adjoining one another in the direction of conveyance.

13. The device in accordance with claim 7, wherein the means for accelerating and for clock cycling the grippers (21) includes a screw conveyor (22).

14. The device in accordance with claim 7, wherein the means for onward conveyance of the grippers (21) includes a clutch drive wheel (23).

15. The device in accordance with claim 7, wherein the means for deactivating the grippers includes a cam (24).

* * * * *